US005523155A

United States Patent [19]

Lin et al.

[11] Patent Number: 5,523,155

[45] Date of Patent: Jun. 4, 1996

[54] FILAMENT HAVING A TRIANGULAR CROSS-SECTION AND 3 OR 6 AXIALLY EXTENDING VOIDS

[75] Inventors: Perry H. Lin, Seaford, Del.; Harry V. Samuelson, Chadds Ford, Pa.

[73] Assignee: E. I. Du Pont de Nemours and Company, Wilmington, Del.

[21] Appl. No.: 439,319

[22] Filed: May 11, 1995

[51] Int. Cl.[6] ..... D02G 3/00

[52] U.S. Cl. ..... 428/376; 428/397; 428/92; 428/398

[58] Field of Search ..... 428/397, 398, 428/92, 376

[56] References Cited

U.S. PATENT DOCUMENTS

| | | | |
|---|---|---|---|
| 3,745,061 | 7/1973 | Champaneria | 428/398 |
| 4,020,229 | 4/1977 | Cox, Jr. | 428/398 |
| 4,279,053 | 7/1981 | Payne et al. | 428/398 |
| 5,230,957 | 7/1993 | Lin | 428/398 |
| 5,279,897 | 1/1994 | Goodall et al. | 428/398 |

*Primary Examiner*—N. Edwards

[57] ABSTRACT

Triangular thermoplastic polymer filaments having 3 or 3 pair axially extending voids located along the convex sides of the filament and spinneret plates for producing such filaments.

3 Claims, 2 Drawing Sheets

FILAMENT HAVING A TRIANGULAR CROSS-SECTION AND 3 OR 6 AXIALLY EXTENDING VOIDS

FIELD OF THE INVENTION

This invention relates to a triangular filament having three convex sides and axially extending voids useful as carpet yarn, having good wear performance, good bulk and cover, glitter, good luster, and good soil-hiding and soil repellency properties. The invention is also a spinneret plate for producing the triangular filaments.

BACKGROUND OF THE INVENTION

Champaneria et al. U.S. Pat. No. 3,745,061 discloses synthetic filaments having 3 or 4 axially extending non-circular (in cross-section) voids. The 3 void version disclosed is nearly circular in cross-section.

Payne et al. U.S. Pat. No. 4,279,053 discloses triangular paint brush bristles having 3 axially extending non-circular voids. The voids are in the apexes of the angles.

SUMMARY OF THE INVENTION

The present invention is a textile filament comprising a thermoplastic synthetic polymer having a generally triangular cross-section and three convex sides of approximately equal length, a solid axial core, three non-circular axially extending voids or three pairs of axially extending non-circular voids, where each non-circular void or each pair of non-circular voids is substantially equispaced from each other non-circular void or each of the other pairs of non-circular voids, said three voids or three pairs of voids being located along each convex side of the filament, and a void content of from 8 to 35 percent.

The present invention is also a spinneret plate for making the filaments just described, said spinneret plate having at least one filament forming group of apertures, said group having (a) a central "Y" shaped aperture whose legs are of about equal length and whose legs join at a junction point and at an angle of about 120 degrees, and (b) 3 peripheral slot apertures each of which is located between the legs of the central "Y" aperture, each of the peripheral slot apertures having two ends, the two ends of each of said 3 peripheral slot apertures being adjacent two of the ends of the central "Y" aperture that are not joined. In one embodiment of the spinneret plate the 3 peripheral slot apertures each have a central leg which extends toward the junction point of the legs of the central "Y" shaped aperture.

DETAILED DESCRIPTION

Filaments of this invention may be prepared from synthetic, linear, and thermoplastic polymers which are melt-spinnable. Among the more important polymers are the polyamides, polyesters, and polyolefins. Molten polymer is spun through the spinneret orifices under spinning conditions which give the desired denier and percent void. Specific spinning conditions and spinneret dimensions will vary depending upon the particular polymer and the filament product being spun. Percent void in part dependent upon spinning and quenching conditions. Normally, the percent void can be increased by more rapid quenching of the molten filaments and by increasing the polymer melt viscosity.

Applications for which the filaments of this invention are highly useful normally require a denier per filament within the range of about 3 to about 25.

Figure 1:
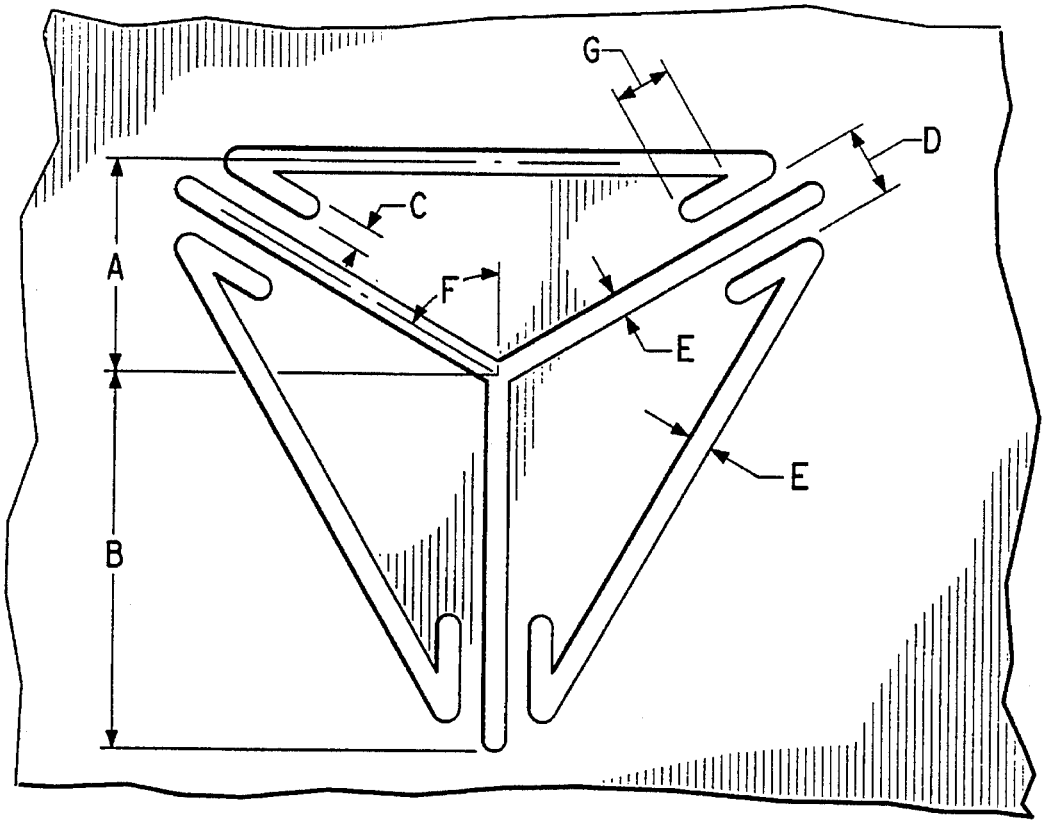
FIG. 1 depicts an enlarged face view of a filament forming group of apertures in a spinneret plate suitable for melt-spinning filaments containing three substantially equidimensional equispaced axially extending voids.

Referring to FIG. 1, the dimensions of the spinneret apertures are as follows: A=0.030", B=0.053", C=0.0028", D=0.0112", E=0.0032", F=60 degrees; and G=0.008".

Figure 2:
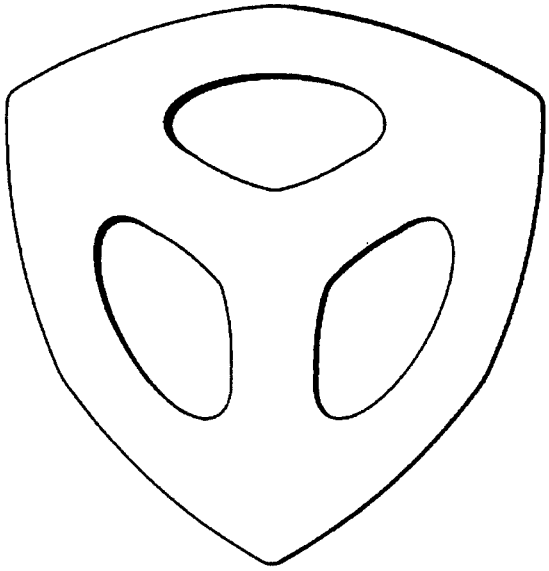
FIG. 2 is an enlarged drawing of a typical three void filament of the invention made by use of the spinneret of FIG. 1.

Referring to FIG. 2, the dimensions of the spinneret apertures are as follows: A'=0.023", B'=0.015", C'0.055", D'=0.0112", E'=0.0032", F'=80 degrees, G'=60 degrees, and H'=0.0036".

The spinnerets of FIGS. 1 and 2 are 0.015" in thickness.

EXAMPLE 1

Using a spinneret plate having filament forming groups of apertures as shown in FIG. 1, nylon 66 polymer was spun at a throughput of 50 kg/hr./position. The filaments were quenched with cross-flow air. The filaments had a cross-sectional configuration approximately the same as that shown in FIG. 2. The filaments had a void content of about 15%. Fifty filaments were combined to form a yarn of 1000 dtex. The yarn had a relative viscosity of 74. The yarns were bulked at 225 degrees C. and had a bulk % of 32.

The yarn was formed into a single yarn velours style carpet, and the carpet was tested for wear performance, soil repellency/hiding and cleanability, glitter, bulk/cover, and aesthetics. The carpet passed all tests satisfactorily. The carpet cleaned better than similar carpet made from yarns in which the fibers were of solid trilobal cross-section.

EXAMPLE 2

Figure 3:
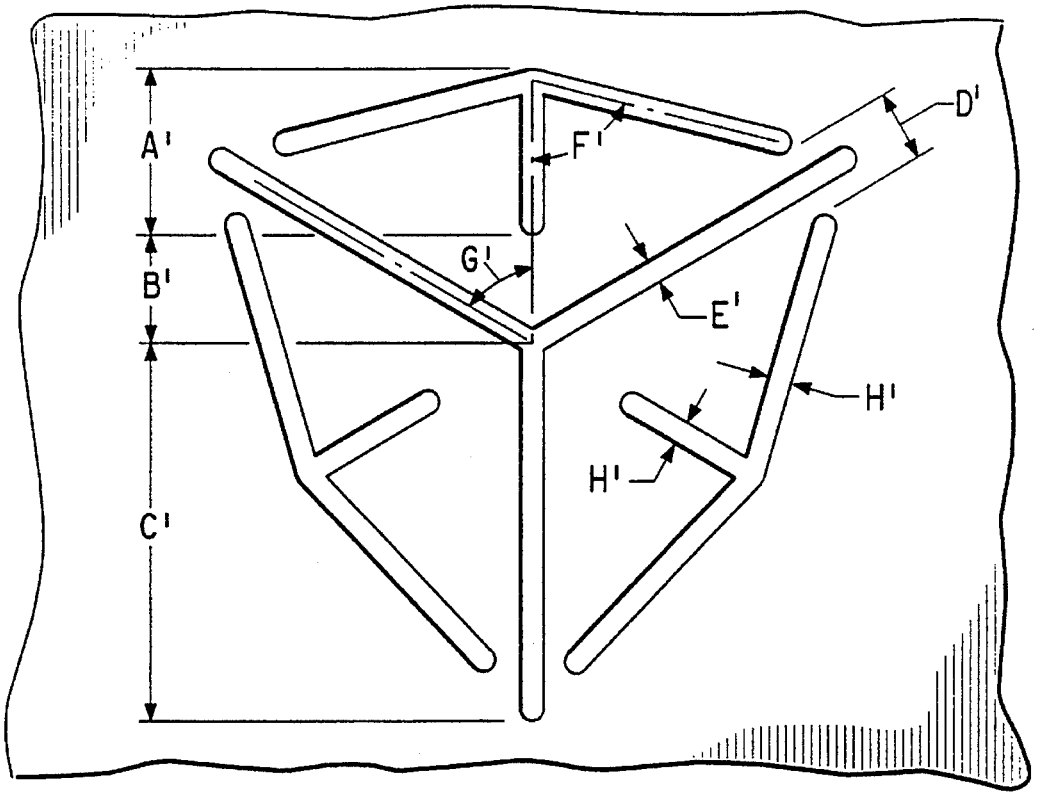
FIG. 3 depicts an enlarged face view of a filament forming group of apertures in a spinneret plate suitable for melt-spinning filaments containing substantially equidimensional equispaced 3 pair of axially extending voids.
Figure 4:
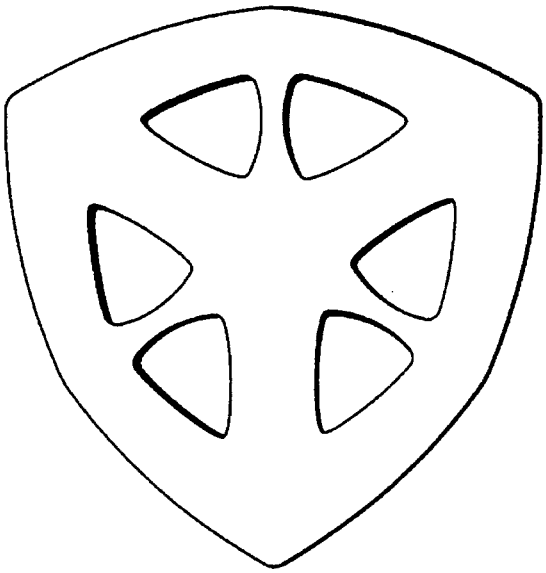
FIG. 4 is an enlarged drawing of a typical 3 pair void filament of the invention made by use of the spinneret of FIG. 3.

Using a spinneret place having filament forming groups of apertures, as shown in FIG. 3, nylon 66 polymer containing 0.30% titanium dioxide was spun at a throughput of 50 kg/hr./position. The filaments were quenched with cross-flow air. The filaments had a cross-sectional configuration approximately the same as shown in FIG. 4. The filaments had a void content of about 12%. Fifty filaments were combined to form a yarn of 1000 dtex. The yarn had a relative viscosity of 74. The yarns were bulked at 225 degrees C. and had a bulk % of 32.

The yarn was formed into a single yarn velours style carpet, and the carpet was tested for wear performance, soil repellency/hiding and cleanability, glitter, bulk/cover, and aesthetics. The carpet passed all tests satisfactorily. The carpet cleaned better than similar carpet made from yarns in which the fibers were of solid trilobal cross-section.

What is claimed is

1. A textile filament comprising a thermoplastic synthetic polymer having a generally triangular cross-section and three convex sides of approximately equal length, a solid axial core, three non-circular axially extending voids or three pairs of non-circular voids, where each non-circular void or each pair of non-circular voids is substantially equispaced from each other non-circular void or each of the other pairs of non-circular voids, said three voids or three pairs of voids being located along the center of each convex side of the filament, and a void content of from 8 to 35 percent.

2. The filament of claim 1 where there are three non-circular voids in the filament.

3. The filament of claim 1 where there are three pairs of non-circular voids in the filament.

* * * * *